US005339934A

United States Patent [19]

Liang

[11] Patent Number: 5,339,934

[45] Date of Patent: Aug. 23, 1994

[54] LUGGAGE STEERING DEVICE

[76] Inventor: Joseph Liang, P.O. Box 1060, Alpine, N.J. 07620

[21] Appl. No.: 8,677

[22] Filed: Jan. 25, 1993

[51] Int. Cl.[5] ..... A45C 5/14; A45C 13/26

[52] U.S. Cl. ..... 190/18 A; 190/115; 280/37

[58] Field of Search ..... 190/115, 18 A; 280/37, 280/47.26

[56] References Cited

U.S. PATENT DOCUMENTS

| | | | |
|---|---|---|---|
| Re. 29,036 | 11/1976 | Hager | 190/18 A X |
| 2,002,836 | 5/1935 | Rossi | 190/18 A X |
| 2,596,578 | 5/1952 | McIntyre et al. | 190/18 A X |
| 3,257,120 | 6/1966 | Browning | 190/18 A X |
| 3,526,921 | 9/1970 | Aupke | 190/18 A X |
| 3,606,372 | 9/1971 | Browning | 190/18 A X |
| 4,256,320 | 3/1981 | Hager | 190/18 A X |
| 4,358,005 | 11/1982 | Fontana | 190/115 X |
| 4,621,404 | 11/1986 | Browning | 190/115 X |
| 4,852,705 | 8/1989 | Cowan, Jr. | 190/18 A |
| 5,022,574 | 6/1991 | Cesari | 190/18 A X |
| 5,044,476 | 9/1991 | Seynhaeve | 190/115 X |
| 5,048,649 | 9/1991 | Carpenter et al. | 190/18 A |
| 5,178,244 | 1/1993 | Liang | 190/18 A |
| 5,181,590 | 1/1993 | Carpenter et al. | 190/115 X |
| 5,197,579 | 3/1993 | Bieber et al. | 190/18 A |

FOREIGN PATENT DOCUMENTS

| | | | |
|---|---|---|---|
| 3636064 | 4/1988 | Fed. Rep. of Germany | 190/115 |

*Primary Examiner*—Sue A. Weaver

*Attorney, Agent, or Firm*—Cohen, Pontani, Lieberman, Pavane

[57] ABSTRACT

A luggage steering device is formed of a hollow sleeve carried on a front wall or side of a typically wheeled article of luggage. Within the sleeve is coaxially positioned a hollow tube capable of axial rotation within and relative to the sleeve. A rigid steering rod is mounted for longitudinally-slidable coaxial insertion into and extraction from the tube. Hingedly connected to the rigid rod is an anchor which remains captively within and in predetermined axial registration with the tube while the rigid rod and hinge portion are extracted from the tube. The pivotal connection allows the rigid steering rod to be pivotally displaced upwardly and downwardly in a substantially vertical plane. The axial registration of the steering rod anchor to the swiveling inner tube assures that, in addition to vertically pivotal movement, the steering rod may be radially swiveled or rotated about a substantially horizontal plane by virtue of a mechanical connection between the anchor and the inner tube. This concurrent pivotal and swiveling motion of the steering rod enables the user to exert pulling forces on the article in a selectively variable direction of desired travel without the need to impart unnatural radial forces to the front wall of the suitcase, thereby greatly improving the steerability and maneuverability of the article of luggage.

13 Claims, 4 Drawing Sheets

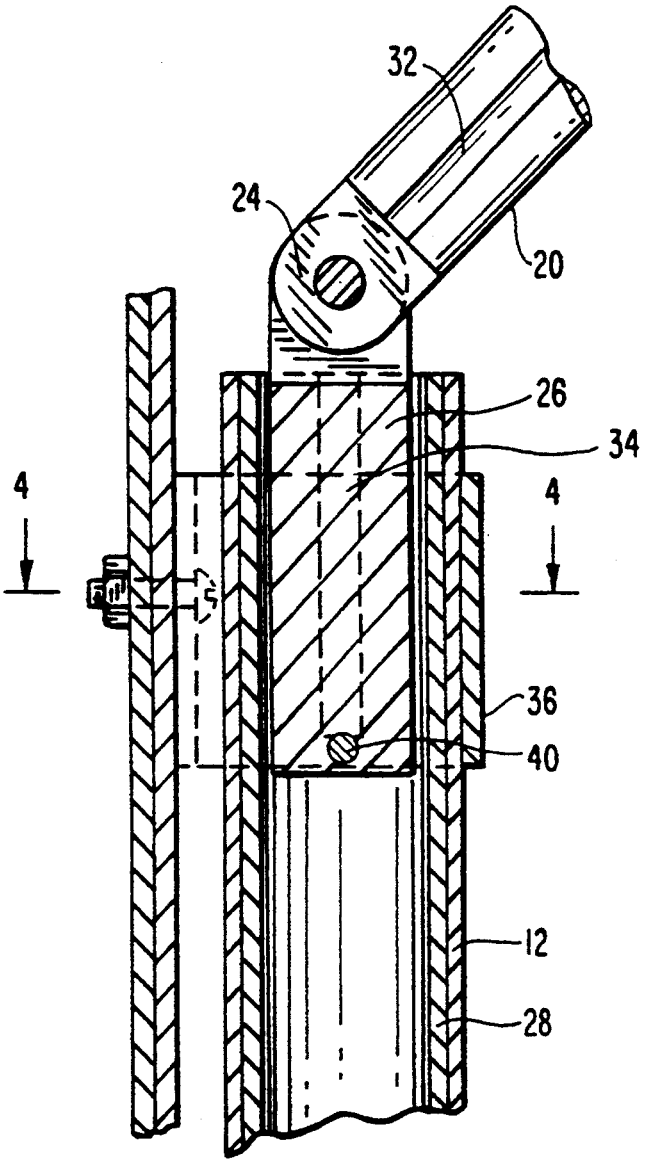
FIG. 3
FIG. 4
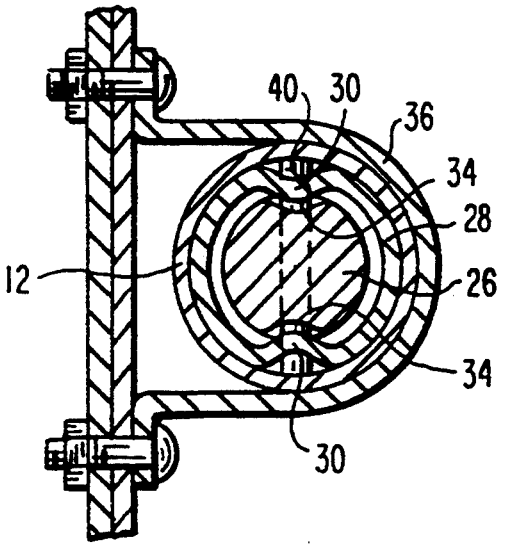

LUGGAGE STEERING DEVICE

FIELD OF THE INVENTION

The present invention is addressed to a rigid, rod-shaped steering mechanism for wheeled or slidable luggage which provides enhanced directional control as the luggage is pulled by a person wishing to convey the luggage in a particular direction.

BACKGROUND OF THE INVENTION

Any person who has ever traveled, or attempted to manipulate a large, heavy piece of luggage, recognizes the difficulties involved in steering and directing a piece or article of luggage in a desired direction. Previous attempts to solve this problem, such as through the provision of wheeled casters, metal sliders, pull handles and straps, have offered some degree of improved steerability, but generally comprise a merely flexible strap which cannot support the luggage during turns and is thus likely to cause or permit the luggage to tip over, or a handle mounted on a rigid rod which has no capability to rotate and follow the direction in which the user is pulling the luggage, such as disclosed in U.S. Pat. No. 5,048,649 to Carpenter et al. These prior art solutions require that the user impart to the article not only a pulling force but, in addition, a rotative force to direct the luggage along a modified or radial path while steering the luggage through a turn or change in direction. It would therefore be highly advantageous to provide an item or article of luggage with a steering mechanism which permits the article to be pulled by a user and which is capable of adjustedly moving in the direction that the user intends to pull the article of luggage and thereby facilitate ease of steering.

SUMMARY AND OBJECTS OF THE INVENTION

The present invention is directed at solving the shortcomings heretofore present in the art of steering luggage by providing a steering rod simultaneously capable of pivotal and rotative movement along arcuate paths in the horizontal and vertical planes to facilitate ease of steering by the user. The steering device may be externally or internally mounted on a side wall of the article of luggage, or may be integrally formed within or otherwise as an integral part of the side wall for concealed operation and/or to meet size or exterior dimensional limitations of the article.

The steering apparatus is comprised of a sleeve formed in or along an outer wall or edge of the piece of luggage. Coaxially within the sleeve is a tube that is longitudinally axially aligned with the sleeve and is capable of swiveling or rotating movement within and relative to the sleeve about its longitudinal axis. Coaxially within this swiveling tube is disposed a steering rod that may be alternately inserted into or longitudinally-outwardly translated to remove the steering rod from within the swivel tube. The steering rod emerges from the tube on that side of the luggage article facing the direction of travel and proximate the top surface of the luggage upon which a conventional suitcase handle or the like is generally mounted. The steering rod is segmented into two portions, a first portion completely removable from within the tube and an anchor portion which is retained within the tube when the first portion moved to its outwardly-disposed position. The two steering rod sections are connected by a pivotal hinge which permits angular movement between the two sections along a single plane. In use, the steering rod is pulled or withdrawn from the swiveling tube to a point at which the hinge is disposed outside of the tube while the second, anchor portion of the steering rod remains within the tube. The anchor portion of the steering rod and the swiveling tube carry a groove and flange arrangement which permits longitudinal displacement of the anchor portion along and within the swiveling tube while assuring that, as one of the two rotates relative to the sleeve, the other is correspondingly rotated. As the user of the steering mechanism pulls the article of luggage in a particular direction, the steering rod first portion is free to pivot up and down to accommodate varying hand heights or elevations of the user while simultaneously swiveling in an arcuate path coveting a range of motion of approximately 180° defined in a substantially horizontal plane parallel to the underlying ground or supporting surface along which the luggage is being pulled. This simultaneous pivoting and swiveling capability permits the user to exert an efficiently-translated pulling force on the steering rod and, thereby, on the article of luggage in any given or user-selected direction within the steering rod's range of motion. The front edge or face or side of the suitcase will thus be reoriented and directed in the selected particular direction without the need for the user to impart other rotative forces directly on or proximate the front of the article. This permits greater steerability and ease of use since the user need merely travel in any desired direction while pulling the luggage behind, and the front face or side of the suitcase will follow without regard to changes in the desired direction of movement.

It is therefore an object of the invention to provide a retractable steering mechanism for an article of luggage which is simultaneously pivotable in a direction perpendicular to the desired direction of travel and swivelable in an arcuate path substantially parallel to the underlying supporting surface.

It is also an object of the invention to provide a steering mechanism which may be easily retracted into a concealed storage position when steering of the luggage is not required.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims.

DETAILED DESCRIPTION OF THE DRAWINGS

In the drawings, wherein like reference characters denote similar elements throughout the several views:

FIG. 3 is a sectional side detail view of a portion of the inventive steering mechanism, taken along the lines 3—3 in FIG. 2;

FIG. 4 is a sectional top view of the inventive steering rod base oriented within the swivel tube and sleeve, taken along the lines 4—4 in FIG. 3;

DETAILED DESCRIPTION OF THE PREFERRED EMBODIMENTS

Figure 1:
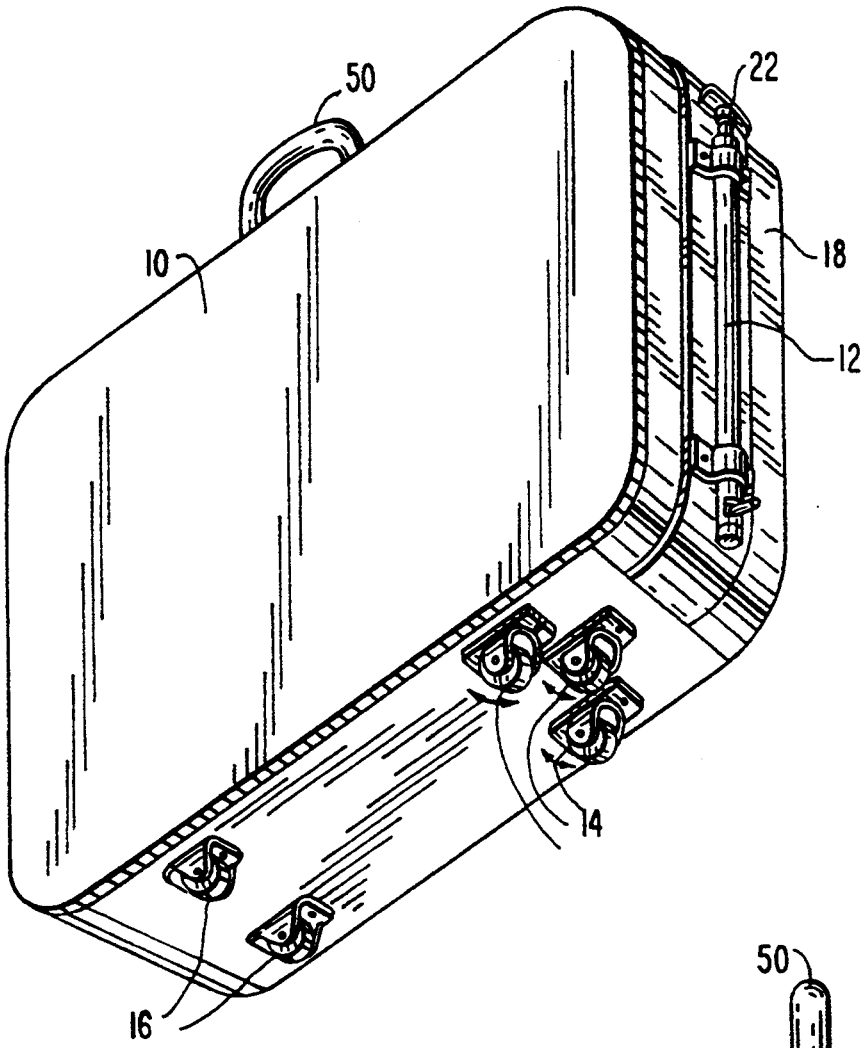
FIG. 1 is a bottom perspective view of an article of luggage incorporating a steering mechanism constructed in accordance with the teachings of the present invention.
Figure 2:
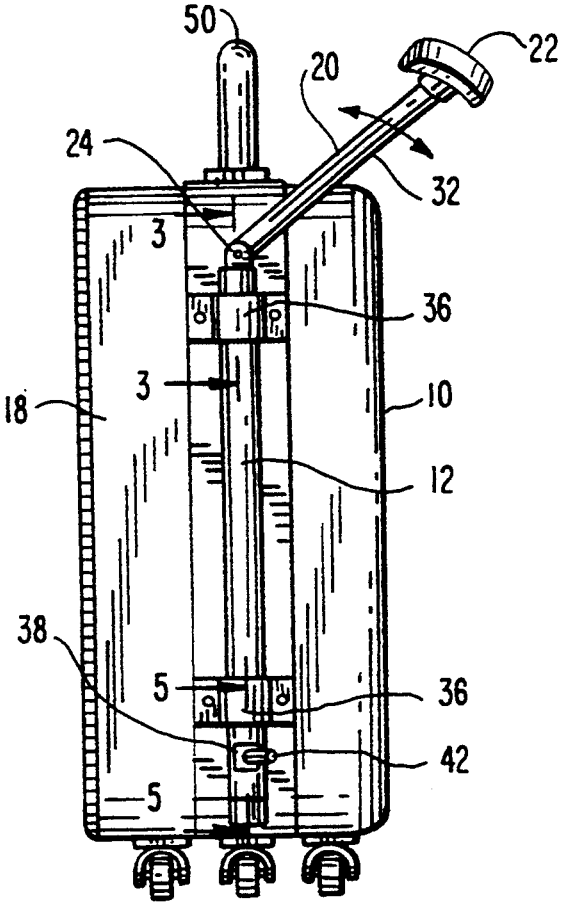
FIG. 2 is a front end view of an article of luggage showing the inventive steering mechanism mounted on a front face of the article and with the steering rod outwardly extended in operative position.
Figure 2A:
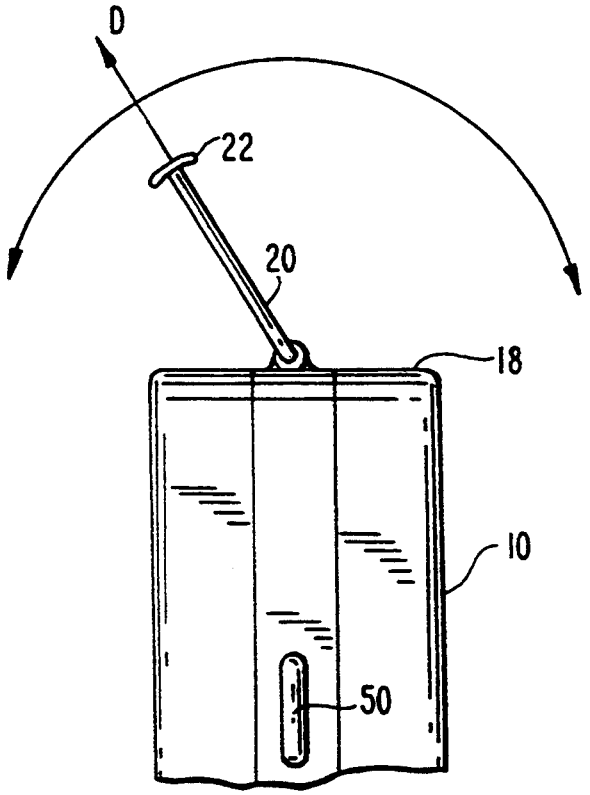
FIG. 2A is a partial top plan view of the steering apparatus of the present invention showing the horizontal arcuate range of motion of the steering rod and pull handle.

With initial reference to FIGS. 1, 2 and 2A, there is shown an item or article of luggage, such as a suitcase 10 provided on its top with a conventional handle 50, having mounted on a forward face or side edge 18, facing a desired direction of travel D, a steering apparatus constructed in accordance with the teachings and contemplation of the present invention. As seen in FIG. 1, the steering apparatus may be mounted on the surface of front face 18 of the suitcase 10, or it may be formed integrally within the suitcase wall (not shown) or mounted within the interior of the suitcase 10 itself (not shown), the particular mounting arrangement generally being a matter of design choice. The suitcase 10 is depicted as having, on a bottom wall or face or surface facing the underlying ground or supporting surface along which the suitcase will be pulled, front wheeled casters 14 and orientationally-fixed rear wheels 16, the front casters 14 being freely rotatable to follow the desired direction of travel D of the suitcase 10 as it is pulled by a user. The particular configuration of the casters or casters illustrated in the drawings, however, is not critical to the invention and the suitcase 10 may, alternatively and by way of example, be configured with two rear wheels and one rotatable forward caster, two rotatable forward casters and a single rear wheel, or other combinations of castors and fixed-orientation wheels, or it may carry or be provided with reduced friction elements or surfaces such as pads or projections coated with a low friction surface material such as Teflon, nylon, etc. For satisfactory operation, it is merely necessary that the suitcase be guidedly movable along a generally (although not necessarily) flat underlying ground or supporting surface, such as a finished floor or the like. The particular arrangement of casters and fixed-orientation wheels, as shown in FIG. 1, should be understood as being merely a currently-preferred configuration.

Referring now to FIG. 2, the inventive steering apparatus is depicted on the front face 18 of the suitcase 10 in its normal operative position. The apparatus comprises an outer tube or sleeve 12 fixedly mounted to the front wall 18 via retaining clamps 36; nevertheless, any known or otherwise suitable mechanical fastening means or elements suitable for permanent affixation on or to the wall 18 may be employed. The sleeve 12 is oriented so as to be substantially perpendicular to the desired direction of travel and to the underlying ground or supporting surface, and may by way of example be formed of aluminum or any other rigid metal or plastic material with suitable strength-to-weight characteristics. Protruding from and movable within the sleeve 12 is an elongated steering rod 20. Rod 20 is substantially tubular and rigid and may also be formed of aluminum or other light-weight metal or plastic materials.

Figure 2B:
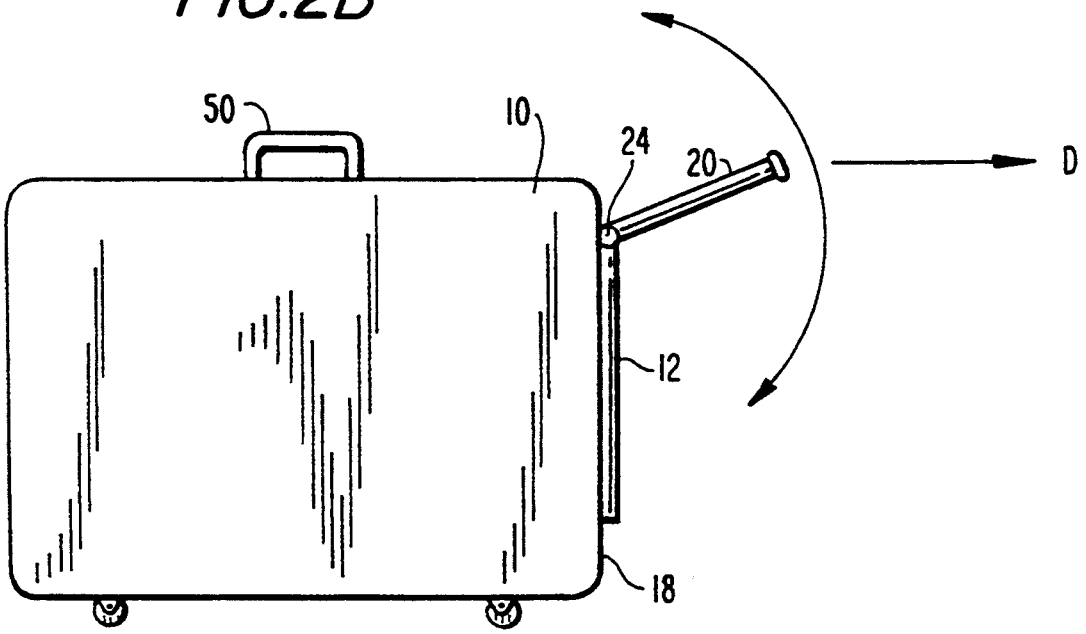
FIG. 2B is a side view of an article of luggage showing the inventive steering mechanism mounted on a front face of the article, with the steering rod extended in operative position and showing the vertical arcuate range of motion of the steering rod and pull handle.

The suitcase is steered by the user grasping and pulling on a preferably T-shaped pull handle 22 fixedly mounted on or forming a part of the rod 20. Handle 22 may alternatively be configured as a circular knob, or a circular or non-circular ting, or any other shape designed, as a matter of design choice, for easy grasping and retention by the user. As seen in FIGS. 2B and 3, the steering rod 20, which in its operative position extends outwardly from the sleeve 12, is capable of pivoting movement at the pivotal hinge 24 through a generally vertical plane substantially perpendicular to the direction of travel D in an arcuate range of motion approximating 180° so as to accommodate variations of the hand height or elevation of users and/or variations in the underlying supporting surface. Steering rod 20 is also simultaneously capable of swiveling or rotation in a generally horizontal plane lying substantially parallel to the intended direction of travel D through an arcuate range of motion approximating 180°, as most clearly shown in FIG. 2A.

The ability of the steering rod 20 to pivot to accommodate the user's height and/or variations in the elevation or orientation of the underlying supporting surface, while simultaneously swiveling so that the rod 20 points or extends in the user-controllable direction of intended travel D, offers a significant improvement over other, heretofore-known steering mechanisms in that the user pulling the suitcase 10 need not directly exert radial forces on or proximate the front edge or wall 18 of the suitcase in order to lead or steer it through a desired change of direction or through a turn. The user need only pull the outwardly-extended steering rod 20 via its handle 22 in the desired direction D. The pulling force exerted by the user on the pull handle 22 in the direction D will directly and automatically impart, through the steering rod 20, the required motive force to the front wall 18 to move the suitcase 10 in the direction D. Due to the ability of the steering rod 20 to simultaneously pivot and swivel, the motive force exerted by the user is linear from the user's perspective, but imparts the necessary radial force component at the suitcase wall or face 18 so that the suitcase follows the desired direction of movement without the need for the user to directly supply this radial force component to the suitcase 10. Additionally, since the rod 20 is rigid, the tendency for the suitcase 10 to tip over during while steering it through turns is greatly reduced if not, indeed, substantially eliminated in normal use.

The elements facilitating the above-described simultaneous pivoting and swiveling movement of the steering rod 20 are most clearly seen in FIGS. 3 and 4. The steering rod 20 is connected by a pivotal hinge 24 to an anchor member 26. The anchor 26 is mounted within a swivel tube 28, which swivel tube 28 is coaxially, rotatably mounted within, and is disposed in axially longitudinal alignment with, the sleeve 12. The anchor 26 is configured for mating engagement with the swivel tube 28 so that as swiveling or rotative motion is imparted to the anchor 26, through the hinge 24, by radial movement of the steering rod 20, the swivel tube 28 swivels concomitantly with the anchor 26 within the sleeve 12.

The anchor is sized with an outer diameter smaller than the inner diameter of the swivel tube 28 so as to enable relative movement or displacement of the anchor 26 within and longitudinally along the swivel tube 28 as the steering rod 20 is variously repositioned longitudinally out of and into the tube 28. The pivotal movement occurring between the rod 20 and anchor 26 through the hinge 24 permits the steering rod 20—which also has an outer diameter smaller than the inner diameter of swivel tube 28—to be brought into axial alignment with the anchor 26 so that the steering rod 20 may be fully inserted into the swivel tube 28 for storage and, in the preferred embodiment, gravity-induced retention therewithin during periods of nonuse, such as may be seen in FIG. 1.

The mating of the anchor 26 with swivel tube 28 may be achieved in any suitable manner which permits or assures concomitant swiveling (i.e. axially-rotative) relative movement between the two elements while also permitting free axial sliding movement of the anchor 26 longitudinally within and along the swivel tube 28. In a preferred embodiment, the swivel tube 28 is configured with a mating ridge 30 in a sidewall of the swivel tube 28 and extending in a direction parallel to the longitudinal axis of the tube 28. The mating ridge 30 extends radially inward, i.e. toward the open center region of the swivel tube 28 in the direction away from the sleeve 12. The anchor 26 is formed with a mating groove 34 sized and configured so as to provide mechanical mating or nested coupling with the mating ridge 30 of the swivel tube 28, thus providing for and permitting longitudinal sliding displacement of the anchor 26 within and along the swivel tube 28.

During periods of nonuse, and as mentioned above, the steering rod 20 may be substantially and is preferably fully retracted into swivel tube 28. When it is desired to move the steering rod 20 to its operative position, the steering rod is pulled, by its pull handle 22, longitudinally out of the swivel tube 28 so that the full length of the steering rod 20 and the pivotal hinge 24 extend beyond and exteriorly of the swivel tube. The anchor 26 is provided with suitable means for limiting its longitudinal range of movement within and along the swivel tube 28 so that it is captured within the tube 28 and the extraction of the steering rod 20 stops when the full length of the rod 20 and the pivotal hinge 24 reach their operative positions outside and clear of the swivel tube. In one currently preferred embodiment of the range-limiting or capture means, as shown in FIG. 3, the anchor 26 is equipped with a pull stop formed by a pin 40 extending transversely through the body of the anchor. In addition, the mating ridge 30 of the swivel tube 28 is formed so as to extend only partially along the swivel tube, and the anchor 26 is sized so that when the pin 40 abuttingly encounters the leading edge of the mating ridge 30, the anchor 26 can no longer be displaced from or pulled out of the swivel tube 28 although, as should be apparent, the rod 20 and hinge 24 do operatively extend from and outside of the tube 28. Of course, other suitable means or structural arrangements for limiting the range of longitudinal motion of the anchor 26 within and along the swivel tube 28 may alternatively be utilized as a general matter of design choice including, by way of example, the provision of an increased diameter of a bottom portion of the anchor 26, or the provision of predeterminately-located alternate projections and stops that are out of alignment with the mating ridge 30.

Figure 5:
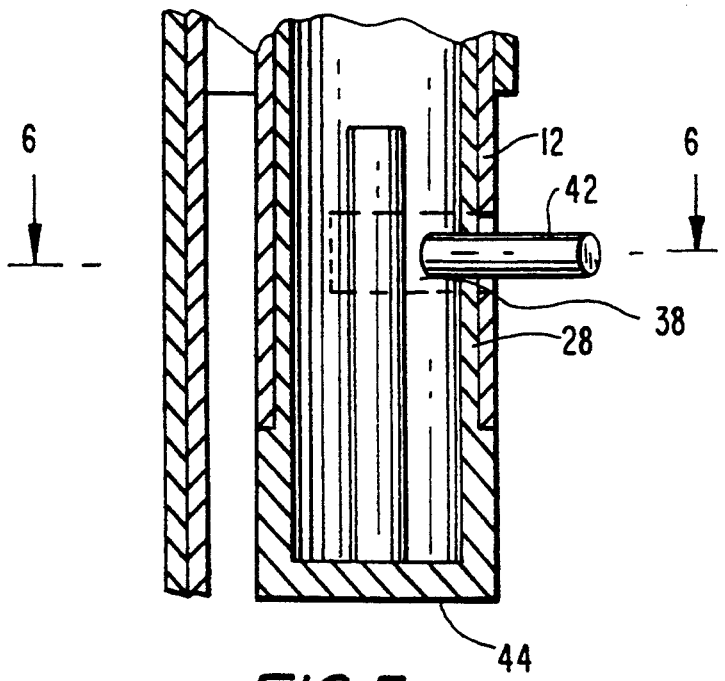
FIG. 5 is side cutaway view of the bottom portion of the steering mechanism of the present invention.
Figure 6:
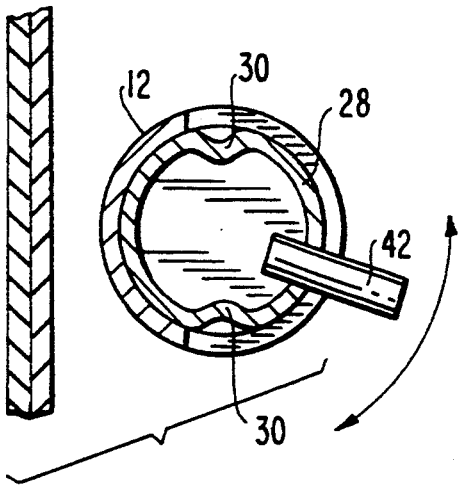
FIG. 6 is a top sectional view of the bottom portion of the steering apparatus of the present invention, taken along the lines 6—6 in FIG. 5.

In a preferred embodiment, the range of axially-rotative motion of the swivel tube 28 is limited by forming a partially-circumferential aperture 38 (see particularly FIGS. 5 and 6) in and through the outer wall of the sleeve 12 proximate the bottom or lower end of the sleeve. Protruding from the swivel tube 28 and extending through the aperture 38 is a swivel stop 42 formed as a rigid projection dimensioned to fit within and through the aperture and to extend beyond the outer diameter of the sleeve 12. The aperture 38 in sleeve 12 is sized to permit, as shown in FIG. 6, approximately a 180° range of axially-swiveling motion of the tube 28 within and relative to the sleeve 12. Thus, the pin-like projection 42 abuts the ends or boundaries of the partially-circumferential aperture 38 to limit the range of axial motion of the swiveling tube 28. Of course, it will be recognized that the particular shape and size of the aperture, and the configuration or implementation of the swivel stop member 42, are merely matters of design choice and, likewise, that other means or arrangements for limiting the range of rotative motion of the swivel tube 28 are within the intended scope and contemplation of the present invention such, for example, as modifying the swivel stop so that it projects radially inward from the sleeve 12 into an aperture defined in the swivel tube 28.

The lower or bottom end of the sleeve 12 may be sealed or closed by an end cap 44 formed, by way of example, as a widening in the outer diameter of the swivel tube 28 as it extends beyond the sleeve 12 so as to simultaneously seal the bottom of the steering apparatus while facilitating the retention of the swivel tube within the sleeve. The sleeve 12 may alternatively be closed or covered by an end cap (not shown) or the like.

Referring once more to FIG. 3, the steering rod 20 is there depicted as including an optional steering rod mating groove 32 defined in and extending longitudinally along the rod 20. When the anchor 26 and steering rod 20 are axially aligned through the pivotal hinge 24, the steering rod mating groove 32 and anchor mating groove 34 will both be in alignment with the mating ridge 30 of the swivel tube 28. With steering rod 20 so configured, continuous alignment of the anchor mating groove 34 with mating ridge 30—and positively-guided longitudinal movement of the rod 20 along the tube 28—is assured during the full range of movement of the steering rod 20 during its extraction from and insertion into the swivel tube 28. This guided alignment eliminates any necessity for or advantage of the continuation of the mating ridge 30 along the entire outer surface of the swivel tube 28, thus enabling realization of the preferred embodiment in which the pull stop 40 is utilized to limit the range of motion of the anchor 26 within the swivel tube 28.

While there have been shown and described and pointed out fundamental novel features of the invention as applied to preferred embodiments thereof, it will be understood that various omissions and substitutions and changes in the form and details of the inventive devices illustrated, and in their operation, may be made by those skilled in the art without departing from the spirit of the invention. It is the intention, however, therefore, to be limited only as indicated by the scope of the claims appended hereto.

What is claimed is:

1. An apparatus for steering an article of luggage as the article is pulled on and along an underlying support surface in a desired direction, the apparatus comprising:

a first elongated tube having a longitudinal axis and fixedly supported on a front side of the article facing the desired direction of travel, said first tube being oriented such that said longitudinal axis is in substantially perpendicular orientation to the support surface;

a second elongated tube disposed coaxially within and extending along said first tube for axial rotation of said second tube relative to the first tube;

a third elongated tube longitudinally movable in a first direction between a first position in which the third tube is coaxially disposed substantially within said second tube and a second position in which the third tube is disposed outside of said second tube, said third tube having a distal end disposed, in said second position of the third tube, remote from the article front side;

an anchor member disposed within said second tube and slidable longitudinally along said second tube, said anchor member being pivotally connected to said third tube;

first means on at least one of said anchor member and said second tube for retaining said anchor member within said second tube when said third tube is moved from said first to said second position; and second means on at least one of said anchor member and said second tube for maintaining axial registration between said anchor means and said second tube when said third tube is in said second position for concomitant rotative movement of said anchor member and said second tube relative to said first tube and axially about said longitudinal axis;

said third tube, when in said second position, being pivotable relative to said anchor member via said pivotal connection, and being concurrently rotatable with said anchor member axially about said longitudinal axis and relative to said second tube, so that as said distal end of said third tube is pulled in a selectively-variable desired direction by a user, said third tube imparts a motive force to said front side of the article in the desired direction so as to directedly steer the article in the desired direction.

2. The apparatus according to claim 1, wherein said second means comprises:

a predeterminately sized, longitudinally extending ridge formed on a surface of one of said second tube and said anchor member and facing the other of said second tube and said anchor member; and a longitudinally extending first trough formed in a surface of the other of said second tube and said anchor member and facing the one of said second tube and said anchor member, said first trough being predeterminately sized and shaped for mechanical mating with said ridge so that when an axially-rotative force is applied to said anchor member from said pivotally-connected third tube, said first trough and said ridge mechanically engage for concomitant axial rotation of said anchor member with said second tube within and relative to said first tube.

3. The apparatus according to claim 1, wherein said first means comprises:

a projection on a surface of said anchor member; and an abutment surface formed on a surface of said second tube and facing said anchor member for abutting contact with said anchor projection when said third tube is moved to said second position so as to restrain said anchor member from further longitudinal movement within and along said second tube and thereby capture said anchor member within said second tube when said third tube is disposed in said second position.

4. The apparatus according to claim 1, further comprising:

third means on at least one of said first tube and said second tube for limiting the axial rotation of said second tube within and relative to said first tube to a predetermined range of axial rotation.

5. The apparatus according to claim 4, wherein said third means comprises:

an elongated aperture formed circumferentially in and through a wall of one of said first tube and said second tube, said aperture having oppositely-disposed boundary edges defining therebetween a circumferential distance measured along said wall; and a rigid member connected to and extending from the other of said first tube and said second tube and through said aperture, said rigid member being sized so as to abuttingly contact said oppositely-disposed boundary edges of said aperture as said second tube axially rotates relative to and within said first tube, said circumferential distance defining a range of axial motion of said second tube.

6. The apparatus according to claim 5, wherein said elongated aperture extends in substantially perpendicular orientation to said longitudinal axis of said first tube.

7. The apparatus according to claim 1, wherein said first tube and said second tube comprise substantially hollow tubes, and said third tube and said anchor means comprise substantially solid rods.

8. The apparatus according to claim 1, further comprising a substantially T-shaped handle on said distal end of said third tube.

9. The apparatus according to claim 2, further comprising:

a longitudinally-extending second trough formed in said third tube in confronting opposition to said second tube, said second trough being predeterminately size and shaped for mechanical mating with said ridge and in longitudinal axial alignment with said first trough for maintaining axial alignment between said first trough and said ridge as said third tube is moved between said first and second positions.

10. The apparatus according to claim 1, further comprising:

a plurality of rotatable wheels mounted on a bottom wall of the article in confronting opposition to the underlying support surface for enabling rolling movement of the article along the underlying support surface.

11. The apparatus according to claim 1, further comprising:

a pair of castor wheels mounted on a bottom wall of the article proximate the front side of the article and in confronting relation to the underlying support surface; and a rear wheel mounted on the bottom wall of the article rearwardly remote from the front side of the article and in confronting relation to the underlying support surface.

12. The apparatus according to claim 11, further comprising a third castor wheel mounted on the bottom wall of the article proximate the front side of the article and in confronting relation to the underlying support surface, said pair and third castor wheels being located on the bottom wall so as to define the vertices of a triangle.

13. An apparatus for steering a wheeled article of luggage as the article is pulled on and along an underlying support surface in a desired direction, the apparatus comprising:

a first elongated, hollow tube having a longitudinal axis and fixedly carried on a front wall of the article facing the desired direction of travel, said first tube being oriented such that said longitudinal axis is in substantially perpendicular orientation to the underlying support surface;

a second elongated, hollow tube disposed coaxially within and extending along said first tube for axial rotation of said second tube relative to the first tube;

an elongated rigid rod longitudinally movable in a first direction between a first position in which said rod is coaxially disposed substantially within said second tube and a second position in which said rod is disposed outside of said second tube, said rod having a distal end disposed remote from the article front wall in said second position of the rod and carrying a handle graspable by a user for pulling the article of luggage;

a rear wheel mounted on a bottom wall of the article in confronting opposition to the underlying support surface and remote from said front wall;

a caster wheel mounted on the bottom wall of the article in confronting opposition to the underlying support surface and proximate said front wall for facilitating steered movement of the article on and along the support surface;

an anchor member disposed within said second tube and slidable longitudinally along and within said second tube, said anchor member being pivotally connected to said rod;

a projection formed on a surface of said anchor member;

an abutment surface formed on said second tube in facing relation to said anchor member for abutting contact with said anchor projection when said rod is moved to said second position so as to captively maintain said anchor member within said second tube in said second position of said rod;

a predeterminately-sized, longitudinally-extending ridge formed on a surface of said second tube in facing relation to said anchor member;

a longitudinally-extending first trough formed in said anchor member in facing relation to said second tube, said first trough being predeterminately sized and shaped for mechanical mating with said ridge so that when an axially-rotative force is applied to said anchor member from said pivotally-connected rod, said engagement of said first trough and said ridge provide concomitant axial rotation of said anchor member with said second tube within and relative to said first tube; and means on one of said first tube and said second tube for limiting the axial rotation of said second tube within and relative to said first tube to a predetermined range of axial rotation;

said rod, when in said second position, being pivotable relative to said anchor member through said pivotal connection, and being concurrently rotatable about said longitudinal axis via said pivotally-connected anchor and second tube so that as said distal end of said rod is pulled in a selectively-variable desired direction by a user, said rod imparts a motive force to said front wall of the article for steered rolling movement of the article on and along the underlying support surface in the desired direction.

* * * * *